United States Patent [19]

Nagata

[11] 3,938,975

[45] Feb. 17, 1976

[54] TREATMENT OF BLAST FURNACE SLAG

[75] Inventor: Takeshi Nagata, Kitakyushu, Japan

[73] Assignees: Nippon Steel Corporation; Hamada Heavy Industries Co., Ltd., both of Japan

[22] Filed: Aug. 16, 1974

[21] Appl. No.: 498,023

[30] Foreign Application Priority Data

Aug. 27, 1973 Japan ..... 48-96864

[52] U.S. Cl. ..... 65/19; 65/68; 106/51

[51] Int. Cl.[2] ..... C03B 1/00

[58] Field of Search ..... 65/19, 68; 106/51

[56] References Cited

UNITED STATES PATENTS

| | | | |
|---|---|---|---|
| 1,962,270 | 6/1934 | Dunn | 106/51 |
| 2,532,548 | 12/1950 | Heide | 69/19 X |

*Primary Examiner*—Arthur D. Kellogg

*Attorney, Agent, or Firm*—Toren, McGeady and Stanger

[57] ABSTRACT

A method for treating blast furnace slag comprising cooling and solidifying the slag discharged from the blast furnace with an aqueous solution containing not less than 0.003% ferrous sulfate and/or ferrous chloride.

8 Claims, 2 Drawing Figures

TREATMENT OF BLAST FURNACE SLAG

This invention relates to the treatment of blast furnace slag comprising adding an aqueous solution containing not less than 0.003% ferrous sulfate and/or ferrous chloride, for example, wasted acid from an acid pickling step of steels, if necessary mixed with a cooling water, to the slag so as to prevent generation of hydrogen sulfide during cooling of the slag and to obtain slag which does not dissolve out percolate. This invention has great advantages in that the wasted acid from the acid pickling step of steels is effectively used for the treatment of blast furnace slag without the problem of public pollution thus eliminating the necessity of a recovery plant for wasted acid.

According to the conventional art, the blast furnace slag in a molten state at high temperature is poured out from the furnace to a slag cooling yard where the slag is cooled and solidified using cooling water and crushed into sand or lamp form to be used as ballasts, grains for concrete and so on. However, during the cooling and solidification with water, water vapour generated by the application of water reacts with the sulfides and polysulfides in the slag to produce hydrogen sulfide.

Now from the point of public pollution, up to 10 ppm of hydrogen sulfide in the atmosphere is allowed in Japan, but from the point of the improvement of working conditions for workers and prevention of corrosion of plants, it has been strongly demanded to suppress the hydrogen sulfide generation as low as possible.

Further, if the non-treated slag is used, percolate (yellowish water) often dissolves out from the slag during its use due to rains, etc. Therefore, in the conventional arts, the slag is exposed to the air for 2 or 3 months before it is used or is limited in its applications.

Meanwhile, hot rolled steel plates are acid-pickled with sulfuric acid or hydrochloric acid before they are supplied to subsequent steps. In this case, a wasted acid recovery plant is required and the wasted acid is regenerated with considerable expense and labour as well as time in order to prevent the public pollution.

One of the objects of the present invention is to provide a method for treating blast furnace slag utilizing ferrous sulfate and/or ferrous chloride contained in the wasted acid from the acid-pickling step, which method can solve the above mentioned problems.

Other objects and features of the present invention will be clear from the following descriptions of examples of the present invention referring to the attached drawings.

EXAMPLE 1

Figure 1:
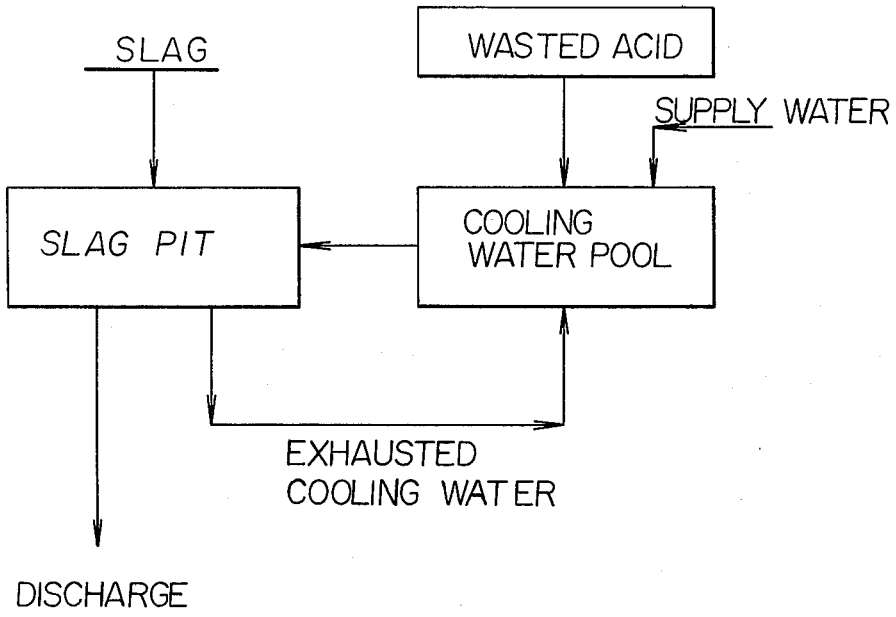
FIG. 1 shows a flow-sheet of one embodiment of the present invention applied for treating the slag in a slag-pit system.

In FIG. 1, wasted acid which is an aqueous solution of ferrous sulfate ($FeSO_4$) or ferrous chloride ($FeCl_2$) is added and mixed in the water pool to adjust the pH value of the cooling water to not less than 3, preferably not less than 5, from the point of corrosion prevention of the equipment, and the cooling water is sprinkled onto high temperature slag flowing out from the blast furnace to the cooling yard to solidify the slag. The hydrogen sulfide produced by the reaction between the sulfides in the slag and the high temperature water vapour is made to react with ferrous salts or ferrous hydroxides produced therefrom and fixed in the slag as stabilized sulfides, such as, ferrous sulfide.

Free acids which are present unavoidably in the wasted acid from the acid pickling step react with unstable sulfur compounds in the slag to form harmless salts and hydrogen sulfide, but this hydrogen sulfide is also prevented from evaporation as the hydrogen sulfide reacts with the ferrous salts or the ferrous hydroxides as above.

Meanwhile, the used cooling water is filtered by the filtering zone below the cooling yard and returned to the water pool, and again mixed with wasted acid and circulated for cooling the slag. In this case, part of the stable fine sulfides which have passed the filtering zone below the cooling yard do not settle or separate in the water pool and are circulated. However, as it does not decompose in the cooling water having a pH value not less than 3 with addition of the wasted acid, it is gradually fixed to the slag during its circulation in the suspended state in the cooling water, and is treated together with the slag.

EXAMPLE 2

Figure 2:
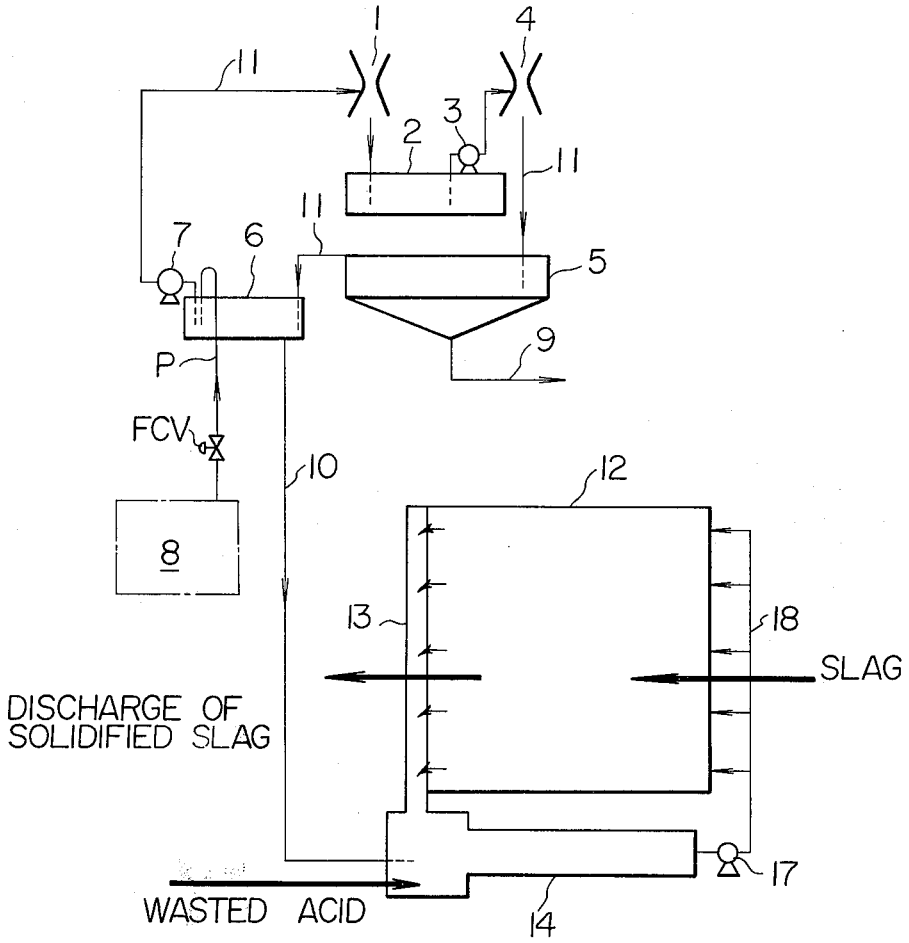
FIG. 2 shows a flow-sheet of another embodiment of the present invention in which water from the blast furnace gas cleaning system is used for the cooling water.

FIG. 2 shows another embodiment of the present invention in which the used water from the blast furnace gas cleaning system is used for the cooling water. 1 is a secondary venturi for cleaning the blast furnace gas, 2 is a pit for water discharged from the secondary venturi, 3 is a pump, 4 is a primary venturi for gas cleaning, 5 is a thickner, 6 is an intermediate pit, 7 is a pump for water circulation, 8 is a fresh water supply line provided in this system. This line supplies fresh water from a water source not shown to the intermediate pit 6 through a pipe line P and a flow control valve FCV using a pressure pump not shown so as to compensate the loss of water due to evaporation scattering and so during its circulation. 9 is a discharging system for discharging dust settling in the thickner 5, 10 is a connecting piping system to the slag treating system, 11 is a water circulation pipe line, 12 is a slag treating yard, 13 is a waste channel, 14 is a recirculating water pit, 17 is a supply pump for cooling water, and 18 is a pipe line for supplying and sprinkling the cooling water.

In this example, the gas cleaning system is composed of the two-stage venturis 1 and 4 arranged in series and the thickner 5, and the treating water is circulated in the system. Meanwhile the slag treatment system is composed of the treating yard 12 and the water pit 14 and the treating water is circulated in the system. The loss of water due to evaporation and scattering in both of the systems is compensated by supplying water to the intermediate pit 6 of the gas cleaning system, and the loss of water in the slag treating system is compensated by supplying water from the intermediate pit 6 to the water pit 14 of the slag treating system.

Similar results as in Example 1 can be obtained by the modification shown in this example, but further additional advantages are obtained as follows.

Namely, since the water from the gas cleaning system has a higher temperature than the ordinary water and is used as the supplying water to the pit 14, addition, dissolution and diffusion thereto of the wasted acid solution (or neutralizing agent) are effectively promoted, and meanwhile complete water circulation of the blast furnace can be attained.

For illustration of the results obtained by the present invention, Table 1 shows the chemical compositions of the wasted acids used in Example 2 and Table 2 shows the main characteristic changes of the recirculating water and the results of dissolution tests by fresh water conducted on blast furnace slag particles of 5 – 30 mm diameters treated by the cooling water obtained by diluting the wasted acids by 800 times in comparision with those obtained by the conventional methods.

Table 1

| Chemical Compositions of Wasted Acids used (% by weight) | A | B | C |
|---|---|---|---|
| Sulfuric Acid | 3.4 | 0 | 1.8 |
| Ferrous Sulfide | 24.3 | 0 | 12.2 |
| Hydrochloric Acid | 0 | 3.0 | 1.4 |
| Ferrous Chloride | 0 | 30.5 | 15.1 |
| Water | 72.3 | 66.5 | 69.5 |

Table 2

| | Results of Dissolution Tests | | | | |
|---|---|---|---|---|---|
| | Present Invention | | | Conventional Method | |
| | 1 | 2 | 3 | 1 | 2 |
| Wasted Acid Used | A | B | C | — | — |
| pH of Cooling Water | 5.1 | 6.0 | 5.7 | 7.3 | 9.1 |
| pH of Discharged Cooling Water | 7.7 | 7.4 | 7.2 | 10.4 | 9.1 |
| Total S Content in Slag after Treatment (%) | 0.33 | 0.85 | 0.75 | 0.58 | 0.83 |
| $H_2S$ in Cooling Atmosphere (ppm) | 0.8 | 2.5 | 2.1 | 4.3 | 6.1 |
| Accumulative Dissolution of S (Dissolved S/slag) (%) 10 days after | 0.05 | 0.07 | 0.06 | 0.15 | 0.17 |
| 30 days after | 0.06 | 0.08 | 0.08 | 0.18 | 0.20 |
| 60 days after | 0.07 | 0.08 | 0.08 | 0.19 | 0.22 |
| 120 days after | 0.07 | 0.09 | 0.09 | 0.19 | 0.23 |
| Color of Dissolution Liquid 120 days after | Colorless | Colorless | Colorless | Yellow | Yellow |

As shown in Table 2, in the conventional methods, dissolution of percolate was observed in the water, whereas according to the present invention no dissolution of percolate was observed thanks to the reactions of the wasted acid and the pH value of the cooling water is satisfactory. These advantages of the present invention can be attributed to the facts that unstable sulfur content in the slag reacts with ferrous salts content in the wasted acid to form ferrous sulfide, and calcium oxide in the slag reacts with the wasted acid to form harmless salts, such as, calcium sulfate or calcium chloride.

Regarding the amount of ferrous sulfate and/or ferrous chloride in the cooling water, it has been found through experiments that not less than 0.003% by weight is desirable, and any cooling water without using the wasted acid but containing ferrous sulfate and/or ferrous chloride not less than 0.003% can be used in the present invention.

The main advantages of the present invention are that the slag can be treated by utilizing ferrous sulfate and/or ferrous chloride in the wasted acids from the acid-pickling plant with in any conventional slag cooling plant only the addition of simple transferring equipment for wasted acid so that almost no hydrogen sulfide is generated during the treating process, the slag thus treated has no problem of percolate dissolution. Also, the wasted acids can be handled simultaneously without much expense, labor and time.

What is claimed is:

1. A method for treating blast furnace slag containing sulfides comprising cooling and solidifying the slag discharged from the blast furnace by spraying an acidic aqueous solution containing not less than 0.003% ferrous sulfate or ferrous chloride onto the slag, said aqueous solution having a pH not less than 3.

2. The method according to claim 1, in which wasted acid from sulfuric-acid pickling of steels is used for the aqueous solution.

3. The method according to claim 1, in which wasted acid from hydrochloric-acid pickling of steels is used for the aqueous solution.

4. The method according to claim 1, in which a mixture of wasted acids from sulfuric-acid pickling and hydrochloric-acid pickling of steels is used for the aqueous solution.

5. A method for treating blast furnace slag containing sulfides comprising supplying a part of the circulation water used in a blast furnace gas cleaning system to a blast furnace slag cooling system wherein said circulating water is sprayed onto the molten slag, adding an acidic aqueous solution containing not less than 0.003% ferrous sulfate or ferrous chloride to the circulation water in the blast furnace slag cooling system, and compensating for the lost of circulation water due to evaporation and scattering in both of the systems by supplying water from outside the systems to the gas cleaning system, said aqueous system having a pH not less than 3.

6. The method according to claim 5, in which wasted acid from sulfuric-acid pickling of steels is used for the aqueous solution.

7. The method according to claim 5, in which wasted acid from hydrochloric-acid pickling of steels is used for the aqueous solution.

8. The method according to claim 5, in which a mixture of wasted acids from sulfuric-acid pickling and hydrochloric-acid pickling of steels is used for the aqueous solution.

* * * * *